United States Patent [19]

Brodeur et al.

[11] 4,356,776

[45] Nov. 2, 1982

[54] CORNER CONNECTOR FOR OPEN TOP RAIL CARS

[75] Inventors: Rene H. Brodeur, Wilmette; Boris S. Terlecky, Fox Lake, both of Ill.

[73] Assignee: Railgon Company, Chicago, Ill.

[21] Appl. No.: 200,403

[22] Filed: Oct. 24, 1980

[51] Int. Cl.[3] ..... B61D 17/06; B61D 17/08

[52] U.S. Cl. ..... 105/406 R; 105/404; 220/1.5; 296/29

[58] Field of Search ..... 105/363, 404, 406 R, 105/406 A, 409, 410; 296/29, 30, 36, 181; 220/1.5

[56] References Cited

U.S. PATENT DOCUMENTS

| | | | |
|---|---|---|---|
| 1,519,093 | 12/1924 | Weymann | 296/30 X |
| 1,822,448 | 9/1931 | Morin | 312/258 |
| 2,081,975 | 6/1937 | Anderson | 105/406 R X |
| 2,648,294 | 8/1953 | Sheehan et al. | 105/406 R |
| 2,651,268 | 9/1953 | Casciano | 105/379 |
| 3,315,835 | 4/1967 | Katzman | 220/6 |
| 3,955,845 | 5/1976 | Werner | 296/36 X |
| 3,999,676 | 12/1976 | Trebilcock et al. | 220/6 |
| 4,177,907 | 12/1979 | Funaioli et al. | 220/1.5 |

*Primary Examiner*—Randolph A. Reese

*Attorney, Agent, or Firm*—Jay G. Taylor; Robert V. Jambor

[57] ABSTRACT

Disclosed is a corner connection for open top type rail cars such as gondolas, hoppers, etc. The top side chords of the rail cars have plates mounted to the upper and lower surfaces thereof which extend beyond the end of the top side chords. Circular openings are formed through the extending ends of the plates which align with a circular opening through the end of the top end chord when the end chord is positioned between the plates. A pin is positioned through the opening in the plates and the opening in the end chord so that a flexible corner connection is formed between the side chord and the end chord that will absorb stresses such as those occurring during loading, humping, or load shifts, without fixed end moments or failure at the upper corner connection of the rail car.

5 Claims, 3 Drawing Figures

CORNER CONNECTOR FOR OPEN TOP RAIL CARS

BACKGROUND OF THE INVENTION

1. Field of the Invention

The present invention relates to construction of railroad cars, and more particularly, to unique construction of corner connectors of open top rail cars such as gondolas and hoppers which eliminate fixed end moments at the upper corner of the rail cars.

2. Description of the Prior Art

Heretofore in the art, the upper corner connection of open top rail cars, i.e., the connection of top side chord and the top end chord have been connected by welding or some other rigid, inflexible means of connection. These top chords form the upper edge of the side walls of open top rail cars and serve to reinforce the relative thin gauge steel of the side and end walls. Such corner connections are natural points of fixed end moments whenever forces are laterally applied to either the end walls or the side walls of an open top rail car. For example, during loading, excessive forces are often applied to the side walls because of sway or movement of the load being lifted into the rail car. Also, loads frequently shift during starting, stopping and humping of rail cars in the rail yard, or during movement of the rail car around sharp bends in the track. When loads shift and contact the side or end walls of the rail car, sudden shock forces are applied to the end and side chords of the walls, and such forces are naturally concentrated at the corner connections of the top side chord and top end chord of the open top rail cars. Since these side and end top chords have heretofore been rigidly connected by welding or other such means, such fixed end moments have resulted in fracture of the corner connection either as a result of metal fatigue or sudden excessive stress.

Accordingly, the present invention has been developed to overcome the deficiences of the prior art so as to provide a flexible corner connection that eliminates fixed end moments and premature failure.

BRIEF SUMMARY OF THE INVENTION

The present invention is an improvement for open top type rail cars such as gondolas and hoppers. Such rail cars conventionally include wheel trucks for traversing rails, an underframe mounted on the wheel trucks, a floor supported by the underframe, side walls and end walls mounted to the underframe, and extending upwardly and essentially perpendicularly from the underframe, and reinforcing top side chords and top end chords at the upper edge of the side and end walls. An improved corner connection in accordance with the present invention comprises means for pivotably mounting the ends of the top end chords to the ends of the top side chords so that forces applied to the side and end chords cause the side and end chords to rotate with respect to one another allowing the forces to be absorbed without fixed end moments at or failure of the corner connection of the side chords and end chords.

More specifically, the present invention comprises plate means mounted to the ends of either the side chord or end chord and pivotably connected to the other by a pin that allows slight pivotable rotation between the two members when forces are applied.

Accordingly, it is an object of the present invention to provide a new upper corner connection for open top type rail cars that prevents fixed end moments at or failure of the upper corner connection as a result of forces applied during loading or load shifts.

These and other objects, advantages and features shall hereinafter appear, and for purposes of illustration, but not for limitation, an exemplary embodiment is illustrated in the appended drawings and described in the following detailed description.

DETAILED DESCRIPTION OF THE INVENTION

Figure 1:
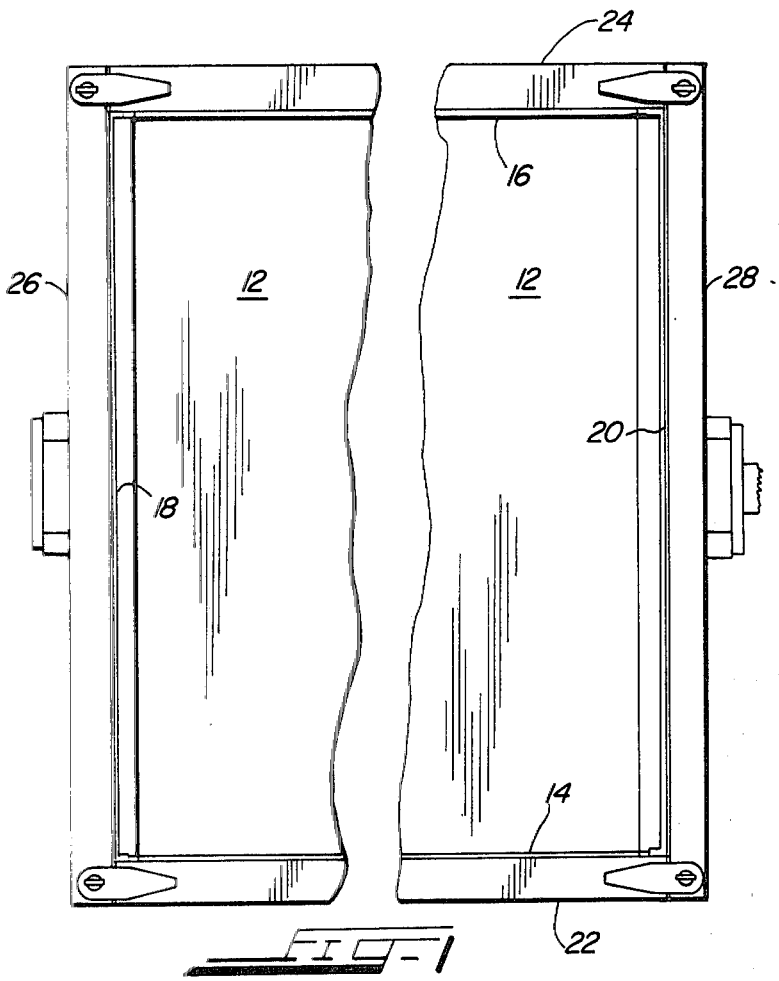
FIG. 1 is a top partially-fragmentary view of a gondola type rail car showing a preferred embodiment of the present invention.
Figure 2:
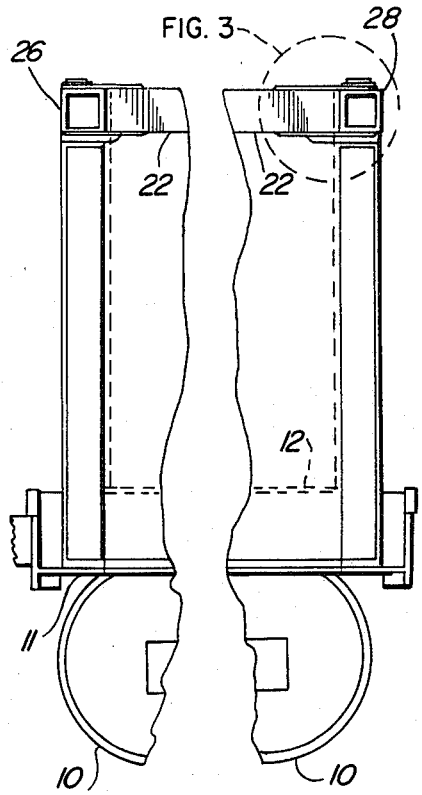
FIG. 2 is a side partially-fragmentary elevational view of the rail car illustrated in FIG. 1.

With reference to FIGS. 1 and 2, an open top rail car is shown comprising wheel trucks 10 of conventional construction for traversing steel rails. The wheel trucks 10 are mounted in a conventional fashion to the underframe 11 of the rail car which supports a side sill 12. Side walls 14 and 16 and end walls 18 and 20 extend upwardly from the underframe of the rail car. Mounted along the upper edge of side wall 14 is a top chord 22. Similarly, mounted at the upper edge of side wall 16 is a top side chord 24.

Similarly, mounted at the top of end walls 18 and 20, respectively, are top end chords 26 and 28. Top chords 22, 24, 26, and 28 are each fabricated as hollow steel tubular members.

Figure 3:
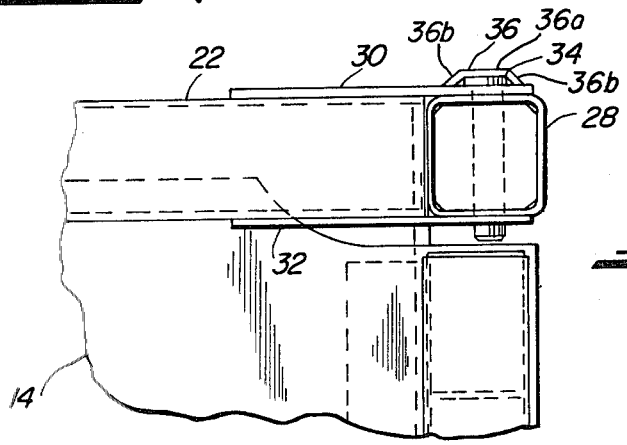
FIG. 3 is an enlarged side fragmentary view of the corner connection illustrated in FIG. 3.

With reference to FIG. 3, an upper plate 30 is mounted on the upper surface of the end of side chord 22 by welding or other suitable means and extends from the end of end chord 22. Similarly, a lower plate 32 is mounted to the lower surface of the end of side chord 22 and extends from the end thereof. An end of end chord 28 is positioned between the extended ends of plates 30 and 32 so that openings through the extended ends of plates 30 and 32 are positioned to coincide with an opening through the end of end chord 28. A pivot pin 34 is inserted through the openings in the upper and lower plates and the end of end chord 28 to form a flexible or pivotal connection. Pin 34 is retained so that it cannot be inadvertently or accidentally removed from the openings by a locking member 36 which retains pin 34 in the openings. Locking member 36 comprises a central portion **36*a* that rests against the upper surface of pin 34. Two end portions 36*b* are connected to each end of central portion 36*a* and extend downwardly at an angle to the upper surface of upper plate 30. The lower ends of end portions 36*b* are connected to upper plate 30** by any appropriate means.

Accordingly, as may be seen, side chord 22 and end chord 28 are pivotally connected and are capable of flexing and pivoting slightly with respect to one another about pin 34. Thus, when forces are applied to the side wall or end walls such as during loading or shifting of loads, the corner connection can deform and flex slightly without fixed end moments and failure. Thus, fatigue and stress fracture of the corner connection between the upper side chord and end chords of an open top rail car are substantially eliminated.

It should be obvious that various alterations, modifications, or changes to the preferred embodiment herein disclosed may be affected without departing from the spirit and scope of the invention as recited in the appended claims. For example, plates 30 and 32 could be rigidly attached to end chord 28 and pivotably pinned to side chord 22. Also, other pivotable connections other than pins could be utilized which would allow flexing of the members wihtout fixed end moments. Accordingly, the present invention should not be limited to the specific embodiment disclosed herein but should be construed to cover any equivalent variations or modifications thereof.

We claim:

1. In an open top rail car including wheel trucks, a rail car underframe mounted on the wheel trucks, a floor supported by the underframe, side walls and end walls rigidly mounted to the underframe and extending upwardly and essentially perpendicularly therefrom, top side chords mounted to the upper edge of the side walls and top end chords mounted to the upper edge of the end walls, an improved corner connector for permanently joining the top end chord to each top side chord comprising:

means for pivotably connecting the end of each top side chord to the end of the top end chord at a single pivot point so that forces applied to the side and end chords cause the side and end chords to pivot with respect to one another at said pivot point allowing the forces to be absorbed without fixed end moments at or failure of the connection of the side and end chords.

2. An improved corner connector as claimed in claim 1 wherein said means for pivotably connecting comprises plate means mounted to an end of the side chord and overlapping an end of the end chord, said plate means having an opening therethrough which aligns with a similar opening in the end chord, and a pivot connector positioned through said openings.

3. An improved corner connector as claimed in claim 1 wherein said means for pivotably connecting comprises plate means mounted to an end of the end chord and overlapping an end of the side chord, said plate means having an opening therethrough which aligns with a similar opening in the side chord and a pivot connector positioned through said opening.

4. An improved corner connection as claimed in claim 1 wherein said means for pivotably connecting comprises:

a first plate mounted to the top of and at the end of the side chord and extending beyond the end of the side chord;

a second plate mounted to the bottom of and at the end of the side chord and extending beyond the end of the side chord;

said first and second plates having an opening formed through the extending ends thereof that align with an opening through an end of the end chord when the end of the end chord is positioned between the plates;

a pivot pin positioned through said openings in said plates and said end chord.

5. An improved corner connection, as claimed in claim 4 further comprising means to prevent said pivot pin from accidentally or inadvertently being removed from said openings.

* * * * *